US005193560A

United States Patent [19]

Tanaka et al.

[11] Patent Number: 5,193,560

[45] Date of Patent: Mar. 16, 1993

[54] CLEANING SYSTEM USING A SOLVENT

[75] Inventors: Masato Tanaka; Tadayoshi Ichikawa, both of Nagano, Japan

[73] Assignee: Kabushiki Kaisha Tiyoda Sisakusho, Koushoku, Japan

[21] Appl. No.: 719,776

[22] Filed: Jun. 24, 1991

Related U.S. Application Data

[62] Division of Ser. No. 412,271, Sep. 25, 1989, Pat. No. 5,051,135.

[30] Foreign Application Priority Data

| | | | |
|---|---|---|---|
| Jan. 30, 1989 | [JP] | Japan | 1-8302 |
| Jan. 30, 1989 | [JP] | Japan | 1-17516 |
| Apr. 20, 1989 | [JP] | Japan | 1-98910 |
| Apr. 20, 1989 | [JP] | Japan | 1-98911 |
| May 29, 1989 | [JP] | Japan | 1-132817 |

[51] Int. Cl.[5] ..... B08B 3/10; B08B 3/12

[52] U.S. Cl. ..... 134/56 R; 134/99.1; 134/107; 134/108; 134/109; 134/184

[58] Field of Search ..... 134/97, 99, 102, 107, 134/109, 113, 184, 108, 56 R, 57 R, 97.1, 99.1, 102.2; 68/3 SS, 18 R, 18 C

[56] References Cited

U.S. PATENT DOCUMENTS

| | | | |
|---|---|---|---|
| 1,615,897 | 2/1927 | Aydelotte | 68/18 C X |
| 2,639,599 | 5/1953 | Wellford, Jr. | 68/18 C |
| 2,906,111 | 9/1959 | Long et al. | 68/3 SS X |
| 3,236,073 | 2/1966 | Davison et al. | 68/18 C X |
| 3,610,002 | 10/1971 | Carpigiani | 68/18 C |
| 3,712,085 | 1/1973 | Guberman et al. | 68/3 SS |
| 4,929,312 | 5/1990 | Westcott | 134/109 X |

FOREIGN PATENT DOCUMENTS

| | | | |
|---|---|---|---|
| 387756 | 10/1973 | U.S.S.R. | 134/184 |
| 2084613 | 4/1982 | United Kingdom | 134/109 |

*Primary Examiner*—Philip R. Coe
*Attorney, Agent, or Firm*—Ladas & Parry

[57] ABSTRACT

A cleaning method and cleaning system using an organic solvent such as Freon. A cleaning tank is closed after an article to be cleaned is placed within the cleaning tank. The solvent is supplied to the cleaning tank from a solvent storage tank. The article is cleaned with the supplied solvent. After the cleaning, the solvent is discharged in liquid state from the cleaning tank while vapor of the solvent which remains in the cleaning tank is discharged to a condenser to condense the vapor. The condensed solvent is returned from the condenser into the solvent storage tank. After the liquid solvent and vapor solvent are discharged from the cleaning tank, the cleaned article is taken out from the cleaning tank. The condenser is incorporated in a distiller. A solvent vapor supplying unit is connected to the cleaning tank. The thus provided closed system prevents release of Freon to the atmosphere.

10 Claims, 9 Drawing Sheets

CLEANING SYSTEM USING A SOLVENT

This is a division of Ser. No. 07/412,271, filed on Sep. 25, 1989, now U.S. Pat. No. 5,051,135.

BACKGROUND OF THE INVENTION

The present invention relates to a cleaning method and system for cleaning an article with a solvent, and particularly but not exclusively relates to a cleaning method and system for cleaning an article, such as a metallic mold, a porous sintered metal and an integrated circuit substrate, using an organic solvent such as Freon (Tradename), trichloroethylene and the like substance.

Heretofore, cleaning systems using an organic solvent, such as Freon and trichloroethylene, are widely used for removing soil adhered to such an article to be cleaned. For cleaning the article, an airtight cleaning tank in which the article is to be placed is evacuated by a vacuum pump so that an organic solvent can easily soak to fine irregular surfaces and fine cavities of the article, and then the organic solvent is supplied from a solvent storing tank into the cleaning tank through a solvent supply pipe. After supplied, the organic solvent is oscillated by means of an ultrasonic oscillator or is agitated by agitating blades to remove soil, such as an oil, adhered to the surfaces of the article. When the article is not cleaned by a single operation, the organic solvent is discharged from the cleaning tank, which is then evacuated by the vacuum pump again. Thereafter, the organic solvent is reintroduced into the cleaning tank and then the article undergoes the cleaning operation. After accomplishing the cleaning, a solenoid valve of a drain pipe which connects the cleaning tank to the storage tank is opened and a draining pump, installed in the drain pipe, is activated to discharge the liquid organic solvent from the cleaning tank into the storage tank. Then, the article is taken out from the cleaning tank.

In the conventional cleaning system, leakage of part of vapor of the organic solvent to the atmosphere is inevitable in supplying and discharging of the organic solvent, and this can results in pollution of the environment. More specifically, the conventional cleaning system has a suction and exhaust pipe mounted to the top of the cleaning tank for communication to the atmosphere, and in addition a gas mixture of air and vapor of the organic solvent is present in an upper space of the storage tank. When the volume of the upper space of the storage tank is reduced by introducing the liquid organic solvent into the storage tank after the cleaning, the gas mixture in the upper space is discharged to the atmosphere through the suction and exhaust pipe, thus contaminating the environment. Particularly, leakage of Freon which is widely used as an organic solvent for cleaning should be as little as possible since it is reported that it will destroy the ozone layer, resulting in destruction of the global environment.

Accordingly, it is an object of the present invention to provide a cleaning method and system in which in cleaning, leakage of the solvent to the atmosphere is prevented with efficient use thereof, whereby the problem to prevent pollution of the environment with the solvent is solved.

SUMMARY OF THE INVENTION

With this and other objects in view, one aspect of the present invention is directed to a cleaning method using a solvent. A cleaning tank is closed after an article to be cleaned is placed within the cleaning tank. The solvent is supplied to the cleaning tank from a solvent storage tank. The article is cleaned with the supplied solvent. After the cleaning, the solvent is discharged in liquid state from the cleaning tank while vapor of the solvent which remains in the cleaning tank is discharged to a condenser to condense the vapor. The condensed solvent is returned from the condenser into the solvent storage tank. After the liquid solvent and the vapor solvent are discharged from the cleaning tank, the cleaned article is taken out of the cleaning tank.

According to another aspect of the present invention, there is provided a cleaning system using a solvent, including: a tubular cleaning tank including a cleaning tank body having an upper open end and a closed bottom, the cleaning tank body being adapted to receive an article to be cleaned, and a closure for sealingly closing the upper open end of the cleaning tank body; a storage tank for storing the solvent, the storage tank having an upper space filled with vapor of the solvent when the solvent is stored; a solvent supplying mechanism connecting the storage tank to the cleaning tank for supplying the solvent from the storage tank to the cleaning tank for cleaning the article; and a solvent distiller, communicating with both the cleaning tank and the storage tank for distilling the solvent from the cleaning tank and returning the distilled solvent to the storage tank.

DETAILED DESCRIPTION OF THE PREFERRED EMBODIMENTS

Figure 1:
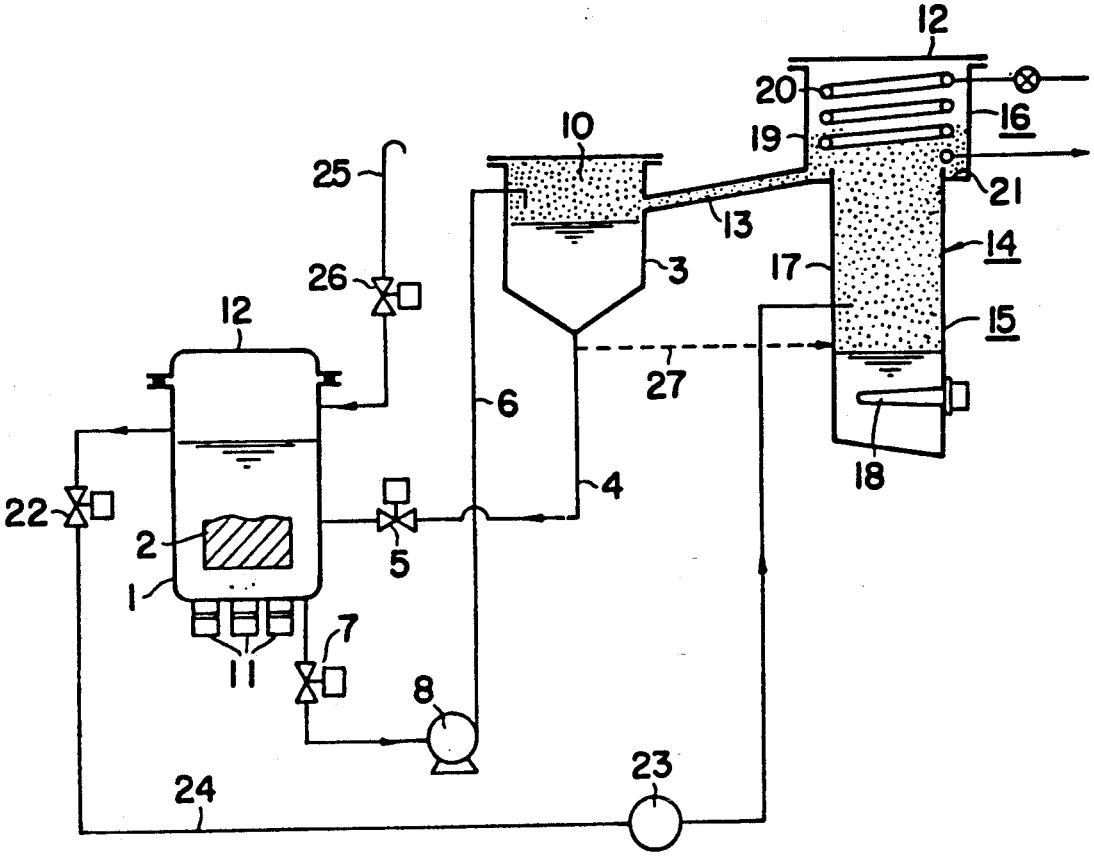
FIG. 1 is a diagrammatic view, in vertical section, illustrating a cleaning system according to the present invention.

The present invention will now be described with reference to the accompanying drawings, in which like reference numerals indicate corresponding parts throughout several embodiments thereof and descriptions thereof are omitted after once given.

Referring now to FIG. 1, reference numeral 1 designates a cleaning tank with an open upper end, which is closed with a closure 12 in an airtight manner. The cleaning tank 1 is provided at its bottom with ultrasonic oscillators 11 for oscillating a liquid organic solvent in it to efficiently clean an article 2 to be cleaned which is immersed in the solvent.

Located at a higher lever than the cleaning tank 1 is a solvent storing tank 3, which is connected at its conical bottom to a middle portion of the cleaning tank 1 through a supply pipe 4 including a solenoid valve 5. By opening the solenoid valve 5, a liquid organic solvent in the storage tank 3 gravitates into the cleaning tank 1 through the supply pipe 4. The storage tank 3 is communicated at its upper portion to an intermediate portion of a distiller 14 (or a trough 21 of a condenser 16) through a connecting pipe 13 so that the organic solvent in liquid and gas state is sent from the distiller 14 to the storage tank 3 for filling a top space 10 of the storage tank 3 with gas of the organic solvent.

The cleaning tank 1 communicates at its bottom portion with an upper portion of the storage tank 3 through a drain pipe 6 which is provided with a solenoid valve 7 and a liquid transfer pump 8. When the solenoid valve 7 is opened, the organic solvent in the cleaning tank 1 is returned to the storage tank 3 by actuating the liquid transfer pump 8.

The distiller 14 has an evaporator 15 disposed at its lower portion and the condenser 16 arranged at its upper portion. The evaporator 15 is provided with a tubular casing 17 having a closed bottom for storing the organic solvent in liquid state and has a heater 18 mounted within a bottom portion of the casing 17 for evaporating the liquid organic solvent. The condenser 16 has a tubular casing 19 closed at its upper open end with a closure 116. In the casing 19, a cooler 20 in the shape of a coil is arranged in the vicinity of the inner wall thereof for condensing vapor of the organic solvent. The evaporator casing 17 is smaller in horizontal cross-sectional area than the condenser casing 19. The evaporator casing 17 passes through the bottom of the condenser casing 19 so that the upper end thereof projects from the bottom. The projected upper end of the evaporator casing 17 and the bottom portion of the condenser casing 19 define an annular condensed organic solvent trough 21. The cooler 20 is located immediately above the annular condensed organic solvent trough 21 so that the organic solvent which is condensed by contacting the cooler 20 drops into the condensed organic solvent trough 21.

The cleaning tank 1 communicates at its upper portion to an intermediate portion of the evaporator 15 through a vapor discharge pipe 24, which is provided with a solenoid valve 22 and a vacuum pump 23. A vapor organic solvent in the upper portion of the cleaning tank 1 is pumped by the vacuum pump 23 to the distiller 14 where it is condensed. In FIG. 1, reference numeral 25 indicates an air suction pipe to introduce air into the upper portion of the cleaning tank 1, and 26 designates a solenoid valve disposed in the air suction pipe 25.

In cleaning the article 2 to be cleaned, the closure 12 of the cleaning tank 1 is opened, and the article 2 is placed into the cleaning tank 1. Then the closure 12 is closed. Subsequently, the solenoid valve 5 is opened to send the organic solvent in the storage tank 3 through the feed pipe 4 to the cleaning tank 1, where the article 2 to be cleaned is subjected to ultrasonic cleaning by actuating the ultrasonic oscillators 11. After completion of the cleaning, the liquid transfer pump 8 is actuated with the solenoid valve 7 opened for returning the liquid organic solvent to the storage tank 3 through the drain pipe 6. As the liquid solvent returns to the storage tank 3, the level of the liquid solvent within the storage tank 3 rises, so that the volume of a vapor solvent space 10 in the upper portion of the storage tank 3 is reduced. This results in that vapor of the solvent filled in the vapor solvent space 10 is forcedly sent through the connecting pipe 13 to the trough 21, through which the vapor solvent enters the condenser 16 of the distiller 14. In the condenser 16, the vapor solvent is cooled and condensed by the cooler 20 arranged along the inner wall of the casing 19 of the condenser 16. The resulting liquid solvent is received in the trough 21 and then returned to the storage tank 3 through the connecting pipe 13.

After the whole liquid solvent in the cleaning tank 1 is returned to the storage tank 3, the solenoid valve 22 is opened and the vacuum pump 23 is activated, so that vapor of the solvent remaining in the cleaning tank 1 is discharged to the evaporator 15 .of the distiller 14 through the vapor discharge pipe 24. The vapor solvent thus returned to the evaporator 15 flows upwards together with solvent vapor already existing in the evaporator 15 into the condenser 16, where it is liquefied by the cooler 20 and then trapped in the condensed solvent trough 21, from which it is returned to the storage tank 3 through the connecting pipe 13.

When a pressure sensor detects that the pressure in the cleaning tank 1 reaches a predetermined vacuum level, it provides an electric signal representing the pressure level to a controller, which in response to this signal closes the solenoid valve 22, deactivates the vacuum pump 23 and opens the solenoid valve 26 to introduce air into the cleaning tank 1 through the suction pipe 25 to raise pressure in the cleaning tank 1. When the pressure in the cleaning tank 1 reaches atmospheric pressure, the closure 12 of the cleaning tank 1 is opened to take out the cleaned article 2.

To regenerate the solvent which has become contaminated by repeated use, the liquid solvent in the storage tank 3 may be sent to the evaporator 15 of the distiller 14 through a regeneration pipe 27 indicated by the dot-and-dash line in FIG. 1.

Although in this embodiment the evaporator 15 and the condenser 16 are integrally combined to constitute the distiller 14, they may be formed separately. In FIG. 1, the condenser casing 19 is built in an airtight manner and in this case pressure therein must be kept within a predetermined range by regulating both the power supply to the heater 18 and the supply of the coolant to the cooler 20. The condenser casing 19 may be made communicative with the atmosphere through a communicating pipe (not shown) which is connected to a top portion thereof, in which case the power supply to the heater 18 and the supply of the coolant to the cooler 20 must be also controlled so that the vapor of the solvent may not be discharged from the condenser 16 to the atmosphere through the communicating pipe.

With such a construction, the cleaning system of this embodiment prevents vapor of the solvent from being released to the atmosphere and hence provides a significant advantage in protecting the environment.

Figure 2:
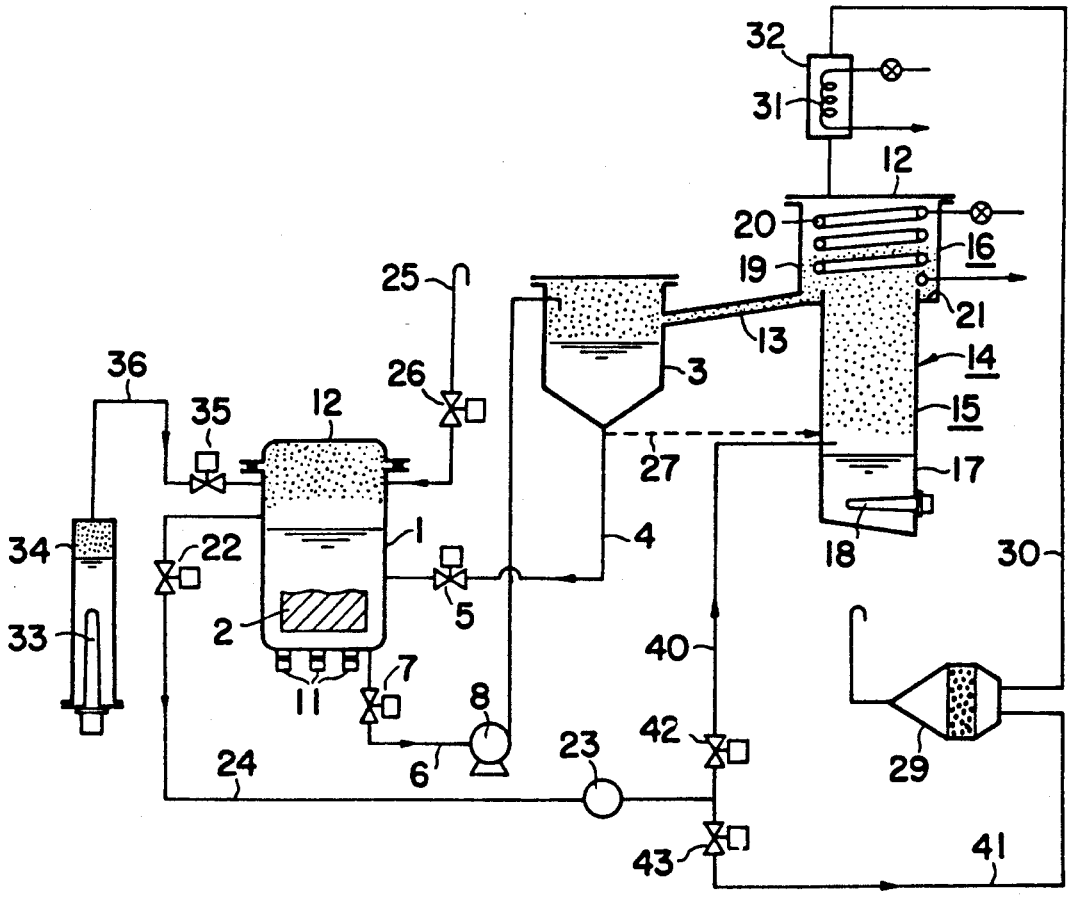
FIG. 2 is a diagrammatic vertical sectional view of a modified form of the cleaning system in FIG. 1.

A modified form of the cleaning system is illustrated in FIG. 2, in which there is provided a vapor supplying unit which includes an evaporator 34, having a heater 33 for evaporating a liquid organic solvent in it, and a vapor supplying pipe 36 having a solenoid valve 35. The vapor supplying pipe 36 connects an upper portion of the evaporator 34 to an upper portion of the cleaning tank 1 for sending organic solvent vapor in the upper portion of the evaporator 34 to the cleaning tank 1 by opening the solenoid valve 35. The condenser 16 communicates at its closure 12, which closes the open upper end of the condenser casing 19, with an activated carbon filter 29 through exhaust pipe 30. The exhaust pipe 30 is provided with a secondary condenser 32 having a cooler 31. In this modification, the vapor discharge pipe 24 is divided at a position downstream of the vacuum pump 23 into a first branch pipe 40 leading to the evaporator 15 and a second branch pipe 41 communicating with the filter 29. The first and second branch pipes 40 and 41 are provided with solenoid valves 42 and 43, respectively.

In operation of the modified system, after the article 2 to be cleaned is placed in the cleaning tank 1 as shown in FIG. 2, the vacuum pump 23 is actuated with the solenoid valve 22 opened so that the cleaning tank 1 is evacuated. In this case, the first solenoid valve 42 is closed while the second solenoid valve 43 is opened. Thus, vapor which is drawn from the cleaning tank 1 is introduced through the second branch pipe 41 into the activated carbon filter 29, where a small amount of the residual solvent which has been used in the previous cleaning operation and remaining in the evacuated vapor is absorbed in the activated carbon filter 29. The resulting filtered vapor is discharged into the atmosphere, and hence release of the solvent into the atmosphere is prevented. After the evacuation of the cleaning tank 1, the solenoid valve 5 is opened to supply the solvent from the storage tank 3 into the cleaning tank 1. The supply of the solvent is efficiently and rapidly performed under the effect of the vacuum suction as well as the effect of gravity. After the cleaning tank 1 is supplied with a sufficient amount of the solvent, the cleaning of the article 2 to be cleaned is carried out by energizing the ultrasonic oscillators 11.

Figure 3:
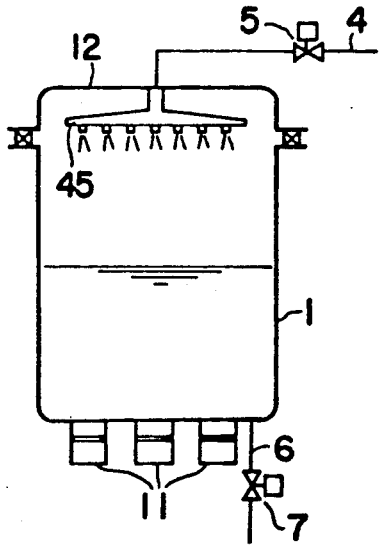
FIG. 3 is a diagrammatic view, in vertical section, of a modified form of the cleaning tank of FIG. 1.

To increase the efficiency of the cleaning of the article 2, the liquid supply pipe 4 may be connected, as shown in FIG. 3, to a shower nozzle 45 which is mounted to the inner surface of the closure 12 for spraying the organic solvent to the article 2. In addition, an agitator or a circulating pump (both members not shown) may be mounted within the cleaning tank 1 to circulate the organic solvent. However, when the article 2 to be cleaned is weak against physical damages, it may be merely immersed in the organic solvent in cleaning tank 1 without undergoing any additional operation including ultrasonic oscillation.

After cleaning with the liquid solvent, the liquid transfer pump 8 is activated at a low speed to gradually return the liquid solvent to the storage tank 3. At the same time, the heater 33 of the evaporator 34 is actuated with the solenoid valve 35 opened, so that vapor of the solvent at a relatively high temperature is supplied from the evaporator 34 to the cleaning tank 1.

This results in that as part of the article 2 to be cleaned is placed above the level of the solvent and exposed to the solvent vapor, the solvent vapor is condensed by contact with the exposed part of the article 2. Thus, the article 2 to be cleaned is subjected to the so called vapor cleaning in which the surfaces thereof undergoes finish cleaning by the clean condensed solvent. During the vapor cleaning, part of the article 2 to be cleaned is exposed to the vapor solvent and the rest is immersed in the liquid solvent, and hence the difference in temperature between the article 2 and the vapor solvent is kept sufficient to condense the vapor, thereby providing a sufficient amount of condensed solvent to the exposed surfaces of the article 2 to be cleaned.

In contrast to this, when the vapor cleaning is performed with the whole article 2 placed above the liquid solvent, the temperature of the article rises as the solvent vapor is condensed, so that the temperature difference between them is reduced with resultant considerable decrease in the efficiency of condensation of the vapor. This decreases the efficiency of the vapor cleaning. When the vapor cleaning is carried out with part of the article 2 immersed in the liquid solvent as in this modified form, the immersed part of the article 2 is cooled with the liquid solvent, thereby sufficiently keeping the temperature difference between the article 2 and the solvent vapor to efficiently condense the vapor by contact with the exposed surfaces of the article.

During the vapor cleaning, the liquid solvent in the cleaning tank 1 may be sent back to the storage tank 3 by raising the pressure of the vapor solvent. In this case the liquid transfer pump 8 may be omitted. By raising the pressure in the cleaning tank 1 during the vapor cleaning, the amount of the condensate increases, so that the efficiency of the vapor cleaning is further increased.

The transportation of the solvent between the cleaning tank 1 and the storage tank 3 may be made only by means of pumps. How to transport the solvent is determined in view of the physical nature of the article 2 to be cleaned, the scale of the equipment, and other factors.

After the whole amount of the organic solvent is returned to the storage tank 3 during the vapor cleaning, the organic solvent vapor remaining in the cleaning tank 1 is returned to the distiller 14 through the discharge pipe 24 and then through the first branch pipe 40 for condensation. To do so, the vacuum pump 23 is activated with the solenoid valves 22 and 42 opened and the solenoid valve 43 closed. When the pressure in the cleaning tank 1 drops to a predetermined vacuum level, the controller closes the solenoid valve 22 and deactivates the vacuum pump 23. At the same time, the controller opens the solenoid valve 26 to suck air into the cleaning tank 1 through the suction pipe 25. This raises the pressure in the cleaning tank 1 to atmospheric pressure, at which the closure 12 is opened to take out the article 2 cleaned.

In this modified cleaning system, the level of the solvent vapor in the condenser 16, that is, the level of the interface between the solvent vapor and the air in the condenser 16 varies in response to introducing and stopping of the solvent vapor through the first branch pipe 40. The larger the variation in the level of the solvent vapor in the condenser 16, the easier the discharging of the gas mixture including the solvent vapor into the exhaust pipe 30. This variation of the level may be reduced by appropriately adjusting the power supply to the heater 18 and the supply of the coolant to the cooler 20, whereby discharge of the solvent vapor through the exhaust pipe 30 may be made as small as possible.

In the cleaning system in FIG. 2, the secondary condenser 32 including the cooler 31 fairly reduces the amount of the solvent vapor exhausted through the exhaust pipe 30, and the activated carbon filter 29 absorbs a small amount of solvent vapor which is inevitably exhausted without being condensed by the second condenser 32.

Figure 8:
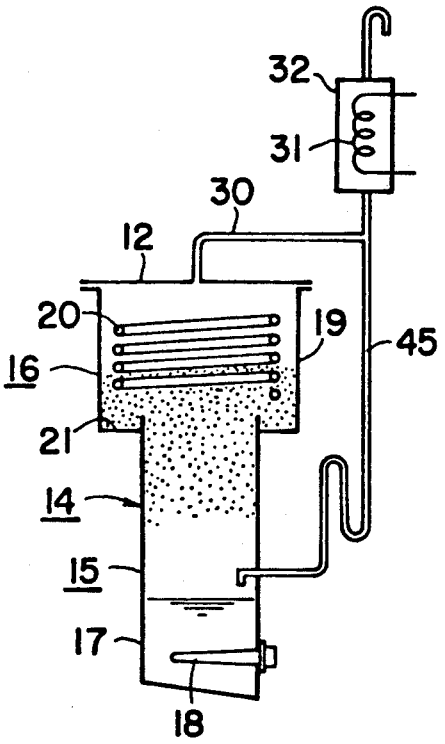
FIGS. 8 and 9 are enlarged diagrammatic views, in vertical section, showing modified forms of a second condenser of the distiller in FIG. 2, respectively.

A modified form of the secondary condenser 32 of FIG. 2 is illustrated in FIG. 8, in which a trap pipe 45 branches off from the exhaust pipe 30 upstream of the secondary condenser 32 and communicates with the evaporator 15. With such a construction, the trap pipe 45 which returns the condensate from the secondary condenser 32 to the evaporator 15 is independent from the exhaust pipe 30 which exhausts the gas mixture from the primary condenser 16, and hence both the discharge of the gas mixture from the primary condenser 16 and the return flow of the condensate to the evaporator 15 are efficiently and smoothly performed.

When the distiller 14 is of a sealed type to which no exhaust pipe 30 is furnished, pressure in the distiller 14 is regulated by adjusting the power supply to the heater 18 and the supply of the coolant to the cooler 20 so that the pressure is not excessively high or low.

Figure 9:
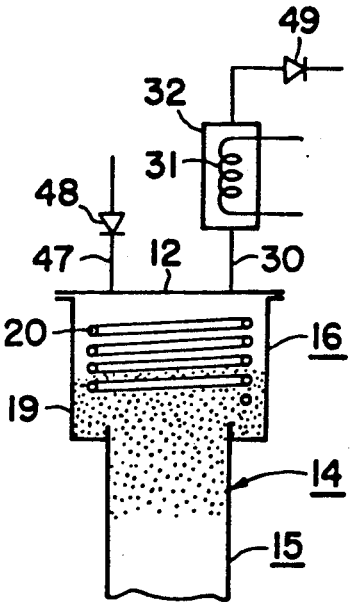

As illustrated in FIG. 9, the condenser 16 may be provided with a suction pipe 47 and an exhaust pipe 30. The suction pipe 47 has a check valve 48 which admits air into the condenser 16 while the exhaust pipe 30 is provided with a check valve 49 which allows a gas to flow to the atmosphere.

Figure 4:
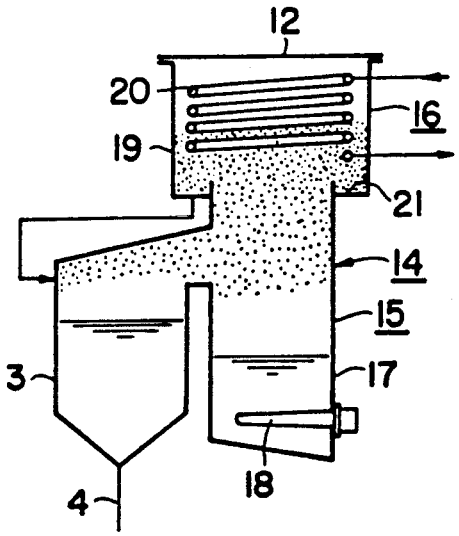
FIGS. 4 and 5 are diagrammatic vertical sections of modified forms of combined storage tank and distiller.
Figure 5:
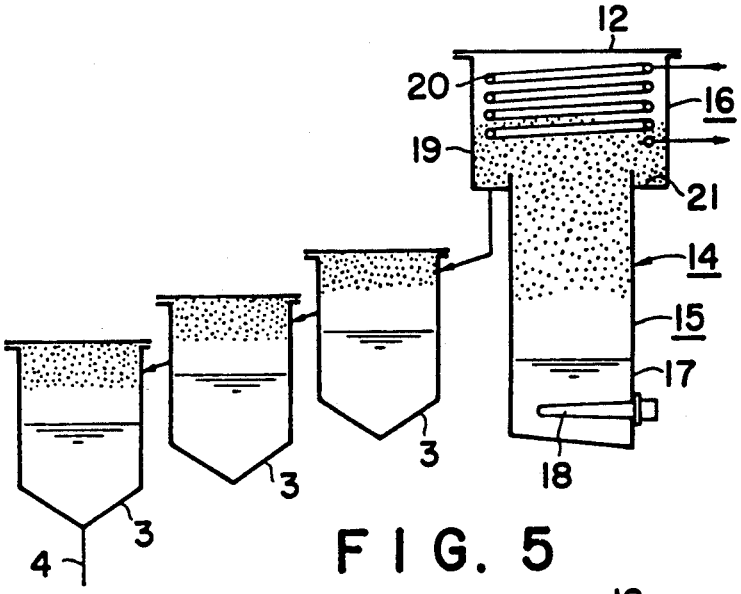

Although the storage tank 3 and the distiller 14 may be provided independently as in FIG. 2, the upper portion of the storage tank 3 may, as shown in FIG. 4, communicate with the upper portion of the evaporator casing 17. As illustrated in FIG. 5, a plurality of storage tanks 3 may be connected in series, and the liquid supply pipe 4 may be connected to the downstream storage tank or lowermost storage tank 3.

Figure 6:
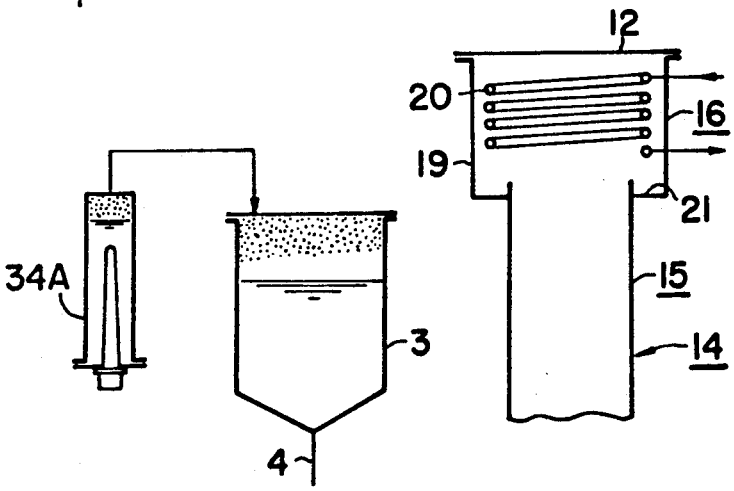
FIG. 6 is a diagrammatic view, in vertical section, showing a vapor supplying unit for supplying vapor of a solvent to the storage tank of FIG. 2.

In the cleaning system of FIG. 2, the upper space of the evaporator 15 of the distiller 14 and the upper space of the storage tank 3 are communicated to fill the latter with the solvent vapor. As illustrated in FIG. 6, the upper space of the storage tank 3 may communicate with an evaporator 34A for supplying vapor of the solvent to it. The evaporator 34A may be also used as the evaporator 34 for supplying vapor of the solvent to the cleaning tank 1. In the storage tank 3 of FIG. 4, the upper space thereof is supplied with the solvent vapor from the evaporator 17 and hence it does not need any evaporator 34A.

Figure 7:
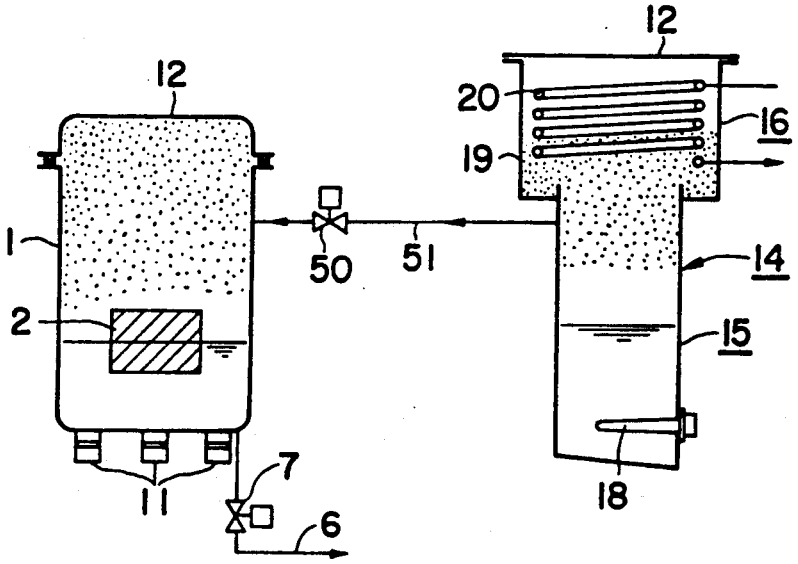
FIG. 7 is a diagrammatic view, in vertical section, illustrating a vapor supplying unit for supplying vapor of the solvent to the cleaning tank.

Although in FIG. 2, the upper space of the cleaning tank 1 is supplied with the solvent vapor from the evaporator 34, the supply of the solvent vapor may be carried out by communicating, as shown in FIG. 7, the upper space of the cleaning tank 1 with the upper space of the evaporator 15 of the distiller 14 through a pipe 51 with a solenoid valve 50.

In the cleaning system of FIG. 2, the vacuum pump 23 serves to discharge both air and solvent vapor from the cleaning tank 1 but two vacuum pumps may be provided to respective independent lines communicating with the cleaning tank 3, one serving as an air exhausting vacuum pump and the other as a solvent vapor exhausting vacuum pump.

Figure 10:
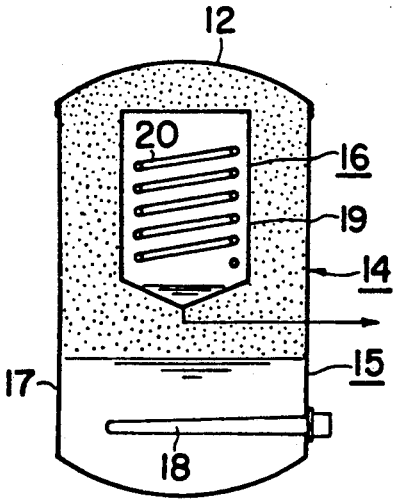
FIGS. 10 and 11 are diagrammatic vertical sectional views of modified forms of the distiller in FIG. 1, respectively.
Figure 11:
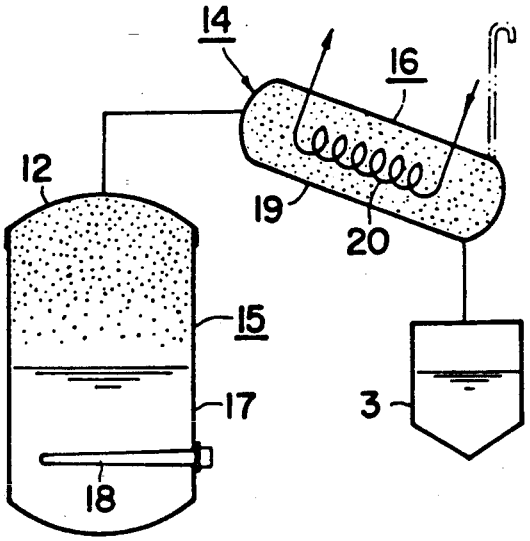

In place of the distiller 14 in FIGS. 1 and 2, a distiller shown in FIG. 10 may be adopted, in which the condenser 16 is smaller in diameter than the evaporator 15 and is built in the latter. Alternatively, the evaporator 15 and the condenser 16 may be separately and independently arranged as illustrated in FIG. 11. In these modified distillers 14, the liquid solvent in the storage tank 3 may be sent to the evaporator 15 through the pipe 27 as in FIG. 2 for regenerating the solvent which has been contaminated by repeated use.

In the preceding cleaning systems of the present invention, pressure in the cleaning tank 1 can exceed atmospheric pressure, that is, it can become positive as the cleaning operation progresses, thereby causing leakage of vapor of the solvent. When an organic solvent such as Freon (Tradename) is used as the solvent, a clamping mechanism is thus needed to clamp the closure 12 against the packing, which is provided to the upper open end of the cleaning tank body for sealing. Such a clamping mechanism makes the cleaning tank 1 rather complicated. In addition, poor airtightness of the closure 12 due to loose clamping or damage of the packing can cause leakage of vapor of the organic solvent from the cleaning tank 1 to the atmosphere, which may cause destruction of the ozone layer.

Also in the case where a cleaning liquid other than the organic solvent is used and highly infectious bacteria adhere to an article to be cleaned, the airtightness of the closure 12 must be sufficiently high and another problem of contamination of the environment can occur.

Figure 12:
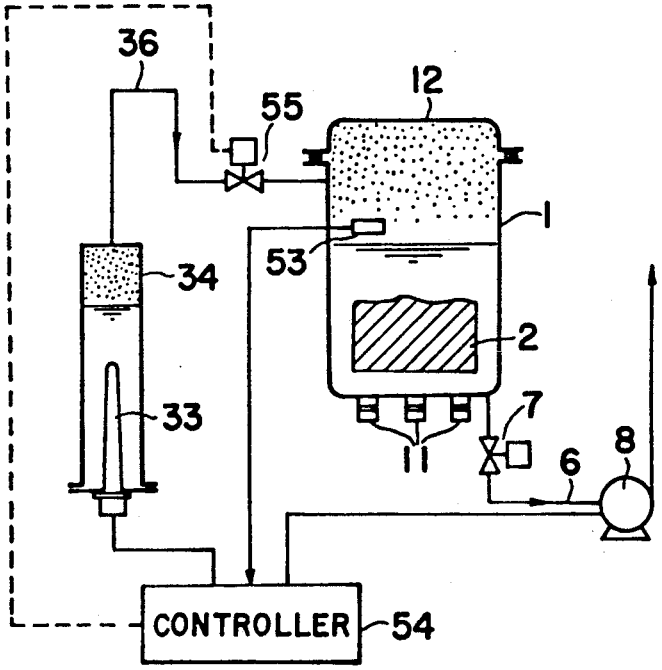
FIG. 12 is a diagrammatic view showing a controlling system for preventing pressure in the cleaning tank of FIG. 2 from becoming negative.

FIG. 12 illustrates a control system which overcomes the problem above mentioned. The control system is provided with a controller 54 which is connected to a pressure sensor 53 which provides a pressure detection signal representing the pressure of the vapor organic solvent at the upper portion of the cleaning tank 1. In response to the pressure detection signal, the controller 54 controls at least one of the heater 33 of the vapor supply unit 34 and the liquid transfer pump 8 so that the discharge of the liquid solvent from the cleaning tank 1 exceeds the supply of the vapor solvent into it thereby to keep the pressure in the upper space of the cleaning tank 1 always negative.

In this modified form, the supply of the vapor organic solvent is regulated by controlling the power supply to the heater 33 of the vapor supply unit 34 but it may be adjusted by a flow-passage-area-variable solenoid valve 55 provided in the pipe 36. The flow passage area of the solenoid valve 55 is controlled by the controller 54 in response to the pressure detection signal. In this modification, the control of the power supply to the heater 33 is not necessary for regulating the supply of the vapor solvent but it saves useless power consumption. Such a flow-passage-area-variable solenoid valve may be used as the solenoid valve 7 which communicates with the liquid transfer pump 8 for regulating the discharge of the cleaning liquid from the cleaning tank 1.

To positively prevent leakage of the vapor of the cleaning liquid, it is preferable to operate the vacuum pump 23 (FIG. 2) of the vapor discharge pipe 24 to keep the pressure in the cleaning tank 1 negative during the cleaning of the article 2 to be cleaned with the cleaning liquid.

Figure 13:
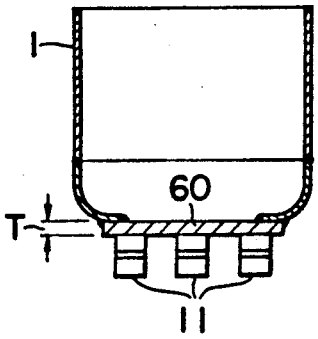
FIG. 13 is a vertical section of a cleaning tank body of a conventional cleaning tank.

The conventional cleaning tank is built by welding a flat plate 60 to the bottom of a cleaning tank body as shown in FIG. 13. As the flat plate 60, a rather thick plate, a steel plate about 5 mm thick for example, is used to withstand pressure when the cleaning tank 1 is evacuated. However, such a thick plate makes it difficult to transmit oscillation of the ultrasonic oscillators 11 to the cleaning liquid of the organic solvent in the cleaning tank 1, thus decreasing the efficiency of the cleaning of the article 2 to be cleaned. To avoid the decrease in the efficiency, the ultrasonic oscillators 11 must be large sized.

Figure 14:
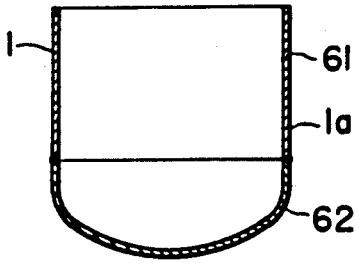
FIG. 14 is a vertical section of a cleaning tank body used in a mode of the present invention.

The cleaning tank illustrated in FIG. 14 solves this problem. The cleaning tank body of the cleaning tank 1 is in the shape of a hollow cylinder with a closed bottom and is composed of a hollow cylindrical wall portion 61 and a bottom portion 62 welded at its upper open end to the lower open end of the wall portion 61. Although not shown, the wall portion 61 is provided at its inner wall with a cleaning liquid supply port directed in a tangential direction of the wall portion 61. In addition, the bottom portion 62 has a cleaning liquid drain port (also not shown) formed through the center of its bottom, the cleaning liquid drain port communicating with the supply port through a pipe with or without a filter. By circulating the cleaning liquid, it may be moved spirally in the cleaning tank 1 about the center thereof. The cleaning tank body is used with a closure on the upper end thereof and an ultrasonic oscillators arranged on the bottom thereof as illustrated in FIG. 1. The bottom portion 62 has a downwardly convex bottom, and the ultrasonic oscillators are mounted directly to the outer surface of the downwardly convex bottom or indirectly to it through a mounting plate (not shown). For this purpose, the ultrasonic oscillators or the mounting plate has a shape complementary to the convex shape of the bottom.

The cleaning tank body is curved outwards at the bottom and hence has a sufficient strength against pressure even if the bottom portion is made thinner than the bottom plate 60 of the ordinary cleaning body. The bottom of the bottom portion 62 may have a bowl shape or a semispherical shape. According to design calculation by the inventors, the bottom portion 62 having a thickness 1.5 mm is sufficient to withstand pressure due to evacuation of the cleaning tank 1 for the cleaning tank body having a circumferential wall portion 61 with an inner diameter 300 mm and the bottom with a curvature radius 450 mm.

In the cleaning system of FIG. 2, before the cleaning operation is commenced with the closure 12 closed, the vacuum pump 23 is actuated to evacuate the cleaning tank 1 so that the article 2 to be cleaned is fully soaked with the organic solvent. However, a small amount of air necessarily remains in the cleaning tank 1 because of the capacity of the vacuum pump 23. When under such a condition, the organic solvent is introduced into the cleaning tank 1 through the pipe 4, the remaining air is trapped in the upper space of the cleaning tank 1, and hence the pressure in the upper space increases by the partial pressure of the residual air. When a cleaning tank 1 is used in which the pressure becomes positive by introducing the solvent, such as Freon or the like substance, rather complicated accompanying equipment is needed as described before. To keep the upper space of the cleaning tank 1 at relatively low pressure the proportion of the volume of the upper space over the total volume of the cleaning tank 1 may be made large. However, this reduces the volume of the space where the liquid solvent is contained for cleaning, that is, the total volume of the cleaning tank 1 minus the volume of the upper space. Thus, the cleaning tank 1 has a smaller upper limit of the volume of the article 2 to be cleaned or it must be made larger for a given volume of the article 2 to be cleaned.

This problem is solved by the following two methods, in both of which the cleaning operation is carried out under negative pressure in the cleaning tank 1 produced by operating the vacuum pump 23. According to the first method, the closure 12 is opened, the article 2 to be cleaned is placed in the cleaning tank 1 and then the closure 12 is closed in an airtight manner. Thereafter, the organic solvent is supplied from the storage tank 3 to the cleaning tank 1 through the pipe 4, and in this condition, the vacuum pump 23 is continually actuated to evacuate air remaining in the upper space of the cleaning tank 1.

In the second method, the vacuum pump 23 is operated before the solvent is sent to the cleaning tank 1. The air which is evacuated by the vacuum pump 23 is directly discharged to the atmosphere without passing through the distiller 14. When air is evacuated from the cleaning tank 1 to some extent, the liquid solvent is sent to the cleaning tank 1, and both the residual air and a vapor produced due to evaporation of the solvent are passed to the distiller 14.

According to these methods, the solvent vapor is continuou sly supplied to the upper space of the cleaning tank 1 by evaporating the liquid solvent in the tank 1, and no air is supplied. Thus, the proportion of air in the gas mixture in the upper space gradually decreases and finally the upper space is filled with only the solvent vapor. It is easy to keep the upper space below 1 atm. (negative pressure) since the pressure of the solvent vapor in the upper space does not exceed 1 atm. if the temperature of the cleaning tank 1 is kept below a predetermined temperature. The solvent vapor in the gas mixture which is sent by the vacuum pump 23 to the distiller 14 through the pipes 24 and 40 is condensed by the cooler 20 and the condensate is recovered by the storage tank 3 as previously described.

In the cleaning system in FIG. 2, the solvent vapor which remains in the cleaning tank 1 is drawn out by operating the vacuum pump 23 but the capacity of the vacuum pump 23 necessarily raises a problem in that a small amount of the solvent vapor still remains in the cleaning tank 1. If under such a condition air is sucked into the cleaning tank 1 though the suction pipe 25 to raise the pressure in it to an atmospheric pressure, and if the closure 12 is then opened to take out the article 2 cleaned, the residual solvent vapor will be released into the atmosphere. The use of a vacuum pump having a higher capacity can fairly reduces the amount of the vapor solvent discharged to the atmosphere, but it raises the equipment cost and is not practical.

This problem is according to the present invention solved by the following two methods. According to the first method, after the cleaning, the liquid solvent is discharged from the cleaning tank 1 as previously described, and then the vacuum pump 23 is operated while air is being introduced into the cleaning tank 1 through the suction pipe 25. This operation enables the residual vapor solvent to be almost completely discharged from the cleaning tank 1 through the pipe 24.

In the second method, before air is sucked through the suction pipe 25, the vacuum pump 23 is operated to discharge the residual vapor solvent from the cleaning tank 1. After the residual vapor solvent is exhausted to the limit of the capacity of the vacuum pump 23, an "appropriate amount of air is sucked into the cleaning tank 1 through the suction pipe 25 to produce a gas mixture made of the residual solvent vapor and air. Then, the gas mixture is exhausted by the vacuum pump 23.

In these methods, air is continuously supplied by opening the solenoid valve 26 through the suction pipe 25 but no vapor solvent is supplied. Thus, the proportion of the vapor in the gas mixture in the cleaning tank 1 gradually decreases and eventually, only air constitutes the gas in the cleaning tank 1. The solvent vapor in the gas mixture which is sent to the distiller 14 by the vacuum pump 23 through the pipes 24 and 40 is condensed by the cooler 20 located at the upper portion of the distiller 14 and is then recovered by the storage tank 3. With such a construction, in addition to the fact that the organic solvent vapor is heavier than air, the introduction of air into the cleaning tank 1 does not cause the vapor solvent to leak to the atmosphere during the operation of the vacuum pump 23.

Figure 15:
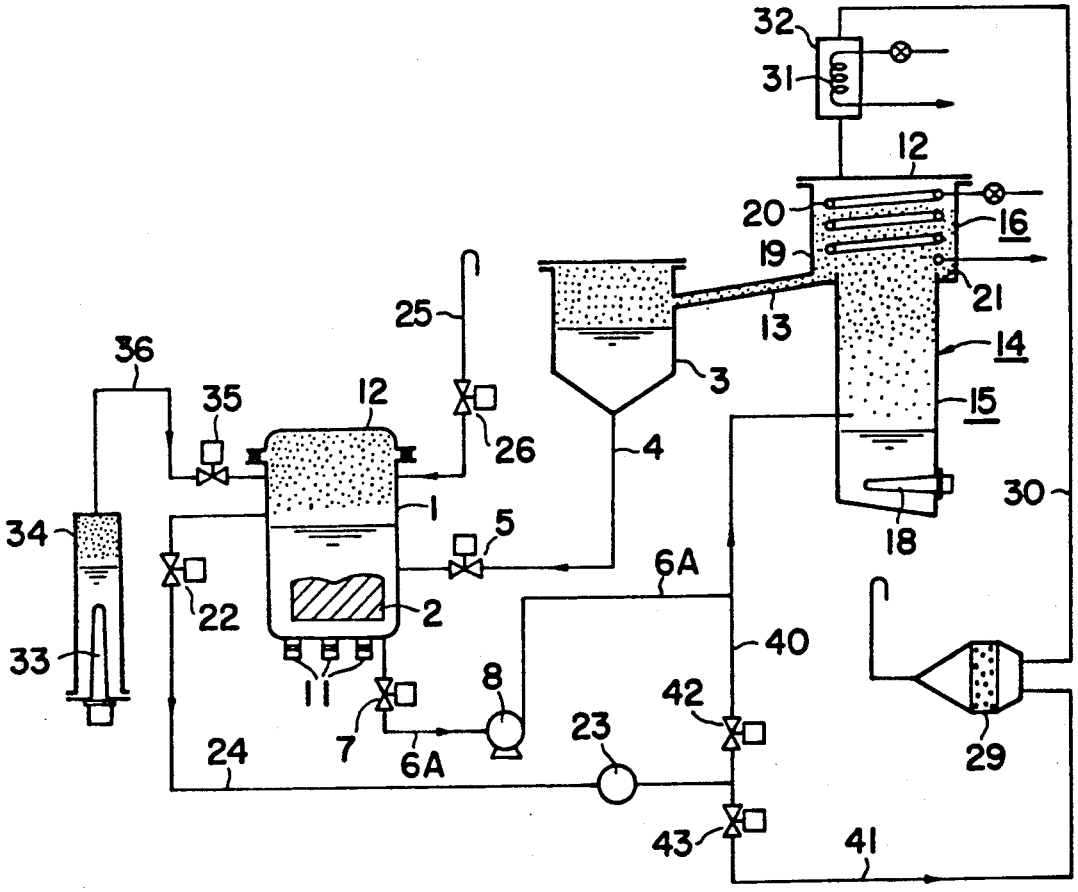
FIG. 15 is a diagrammatic view of a modified form of the cleaning system in FIG. 2, with essential elements in vertical section.

FIG. 15 illustrates a modified form of the cleaning system of FIG. 2. In this modified system, the drain pipe 6 which sends the liquid solvent from the cleaning tank 1 to the storage tank 3 is omitted, and instead a drain pipe 6A is provided for passing the liquid solvent from the cleaning tank 1 to the distiller 14, where the liquid solvent is distilled and then returned as a regenerated solvent to the storage tank 3 as described hereinbefore.

In the cleaning systems of FIGS. 2 and 15, after completion of the cleaning of the article 2, the liquid solvent is sent from the cleaning tank 1 to the distiller 14, where it is evaporated by the heater 18 and then condensed in the cooler 20. This causes a drop in pressure in the distiller 14, so that air is sucked into the distiller 14 through the pipe 30. Vapor in the air sucked condenses into water droplets by passing the secondary cooler 31 or by contact with the cooler 20 of the distiller 14. Water droplets thus produced are mixed with the solvent and sent to the storage tank 3 where it is stored. Thus, the solvent which is to be supplied to the cleaning tank 1 is deteriorated by the mixed water.

Figure 16:
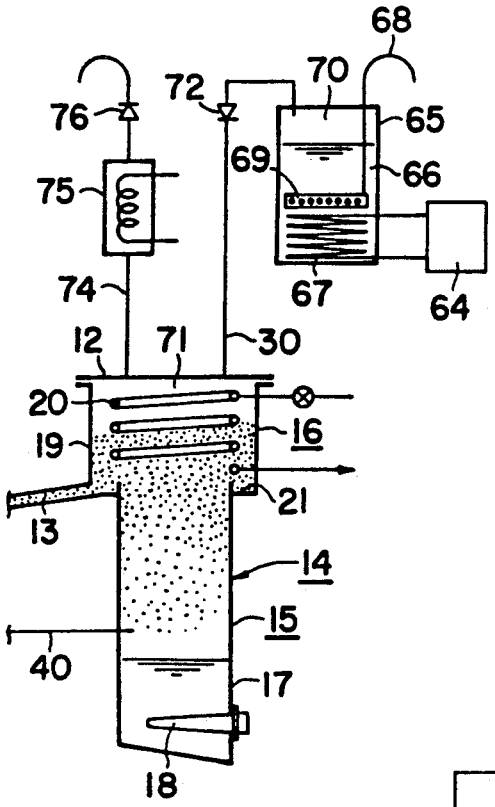
FIG. 16 is an enlarged diagrammatic view of a unit for preventing condensation of water in the distiller of the present invention, with essential elements in vertical section.

FIG. 16 shows a distiller 14 including a moisture removing unit for preventing such deterioration of the solvent. The moisture removing unit includes a sealed container 65, which contains the liquid solvent 66. The sealed container 65 is provided at its bottom portion with an evaporator 67 which constitutes part of a refrigerator 64. The evaporator 67 cools the solvent in the sealed container 65 to about −20° C. for freezing water in a very short time. The reference numeral 68 indicates a suction pipe having one end open to the atmosphere and the other end connected to a porous member 69 immersed in the solvent in the sealed container 65. The porous member 69 may be a perforated pipe or a member made of a porous material. The sealed container 65 is connected at its upper space 70 to the upper closed space 71 of the condenser 16 through a communicating pipe 30. The communicating pipe 30 is provided with a check valve 72 which allows a gas to pass through it only from the sealed container 65 toward the upper closed space 71 of the condenser 16. A release pipe 74 is connected at one end thereof to the closure 12 of the condenser 16 for releasing part of the gas in the closed space 71 when the pressure in the closed space 71 rises. The release pipe 4 is provided with a secondary cooler 75 adjacent to the one end for cooling the gas including the solvent vapor to condense the solvent vapor to recover it. Another check valve 76 is furnished to the release pipe 76 between the secondary cooler 75 and the other end thereof. The other end of the release pipe 74 may be opened to the atmosphere with or without an activated carbon filter for filtering the solvent vapor.

When pressure in the closed space 71 of this modified distiller 14 drops due to condensation of the solvent vapor in the closed space 71 with the cooler 20, air is sucked into the closed container 65 through the suction pipe 68 due to a drop in pressure in the upper space 70. The air thus sucked is introduced into the solvent 66 in the sealed container 65 in the form of fine air bubbles through the porous member 69. The air is sufficiently cooled by passing through the solvent 66, so that water vapor in the air is frozen into ice, which is caused to remain in the sealed container 65. Thus, air in the upper space 70 of the sealed container 65 contains a negligible amount of water vapor and is dry. This air is passed through the check valve 72 into the closed space 71 of the upper portion of the condenser 16, and pressure in the closed space 71 accordingly rises to the atmospheric pressure. As air in the closed space 71 is hence extremely dried, little vapor in the air is condensed by the cooler 20, with the result that little water is mixed into the solvent which flows down into the trough 21. Thus, practically there is no possibility of the solvent being deteriorated by water mixed.

When pressure in the closed space 71 increases, it is caused to drop to the atmospheric pressure by discharging the gas mixture in the closed space 71 to the atmosphere through the release pipe 74. While the pressure in the closed space 71 is decreased in such a manner, little organic vapor is discharged to the atmosphere through the release pipe 74 since the solvent which is contained in the gas mixture is trapped by condensation with both the primary cooler 20 and the secondary cooler 75.

Figure 17:
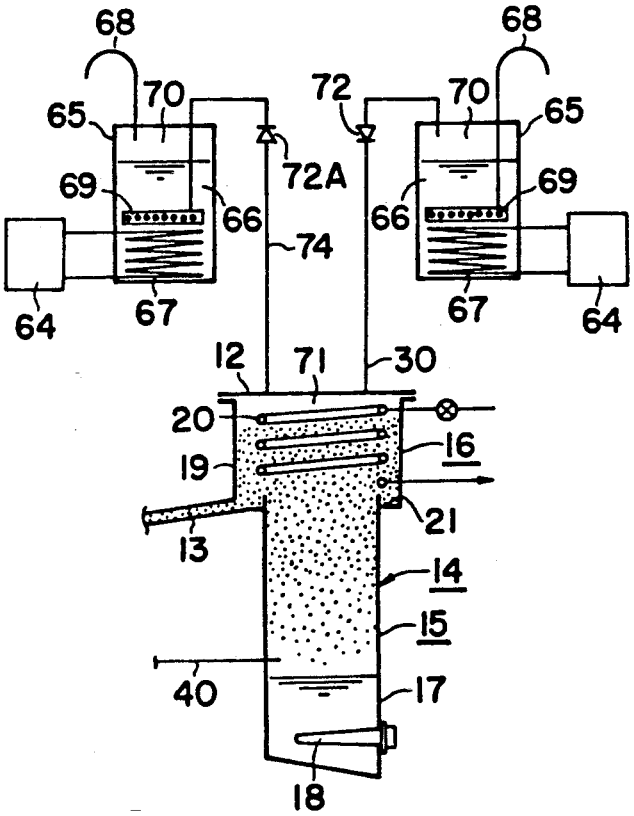
FIG. 17 is an enlarged diagrammatic view of a modified form of the distiller in FIG. 16, with essential elements in vertical section.

A modified form of the distiller 14 of FIG. 16 is illustrated in FIG. 17, in which the release pipe 74 is communicated at the other end with a second moisture removing apparatus which is identical in structure to the first moisture removing apparatus except that the check valve 72A has a release direction in which a gas is only allowed to pass, and which is opposite to the release direction of the check valve 72 of the first moisture removing unit. In this modified form, when the pressure in the closed space 71 rises, it is caused to drop by passing the gas mixture in the closed space 71 through the release pipe 74 into the second sealed container 65, from which it is discharged through a pipe 68 to the atmosphere. During this operation little solvent vapor is discharged to the atmosphere. A major part of the solvent vapor in the gas mixture is trapped in the trough 21 by condensation by means of the cooler 20 disposed in the closed space 71. The remaining part of the solvent vapor, which is not trapped by the cooler 20, is condensed during passing through the cryogenic solvent in the second sealed container 65 and is trapped in it.

The first and second moisture removing units may be arranged within a common sealed container.

Figure 18:
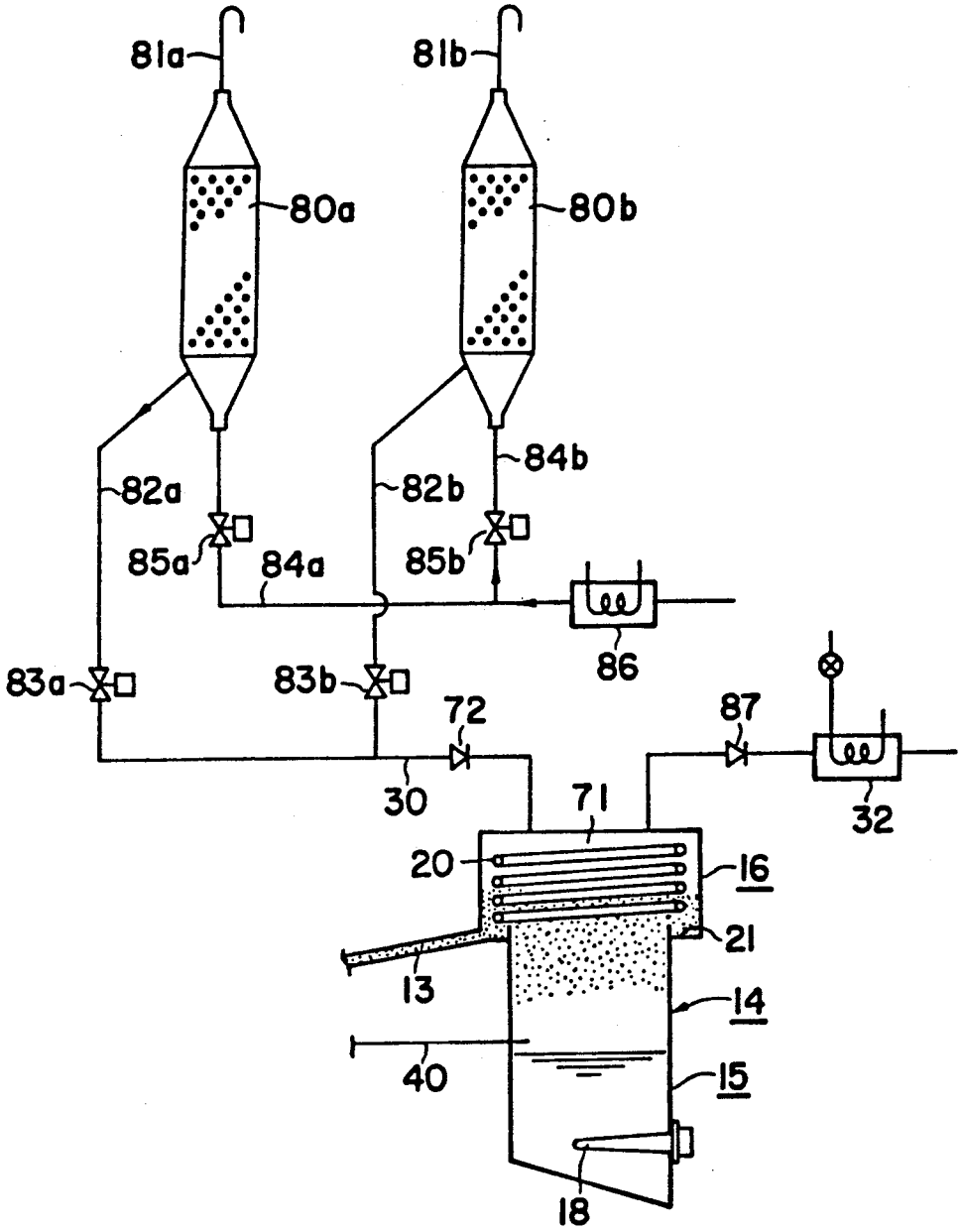
FIG. 18 is an enlarged diagrammatic view, in vertical section, of a modified form of the distiller of FIG. 1.

Referring to FIG. 18, another measure to prevent degradation of the organic solvent due to condensation of water droplets caused by a pressure drop in the distiller 14 will be described. In this modified distiller 14, a pair of dehumidifiers 80A and 80B communicate through a check valve 72 to the closed space 71 of the condenser 16 in parallel with each other. Each of the dehumidifiers 80A and 80B is charged with a regenerable drying agent, such as silica gel and molecular sieve. The dehumidifiers 80A and 80B communicate with the atmosphere through suction pipes 81A and 81B, respectively, and are further connected to the check valve 72 through respective discharge pipes 82A and 82B. The discharge pipes 82A and 82B are provided with solenoid valves 83A and 83B, respectively. The dehumidifiers 80A and 80B are communicated to a hot air producing heater 86 through respective regenerating hot air supply pipe 84A and 84B each including a solenoid valve 85A or 85B. The closed space 71 of the condenser 16 is connected to a secondary cooler 32 through a check valve 87.

When in such an arrangement, the solenoid valve **83*a* of one dehumidifier 80*a* is opened with the solenoid valve 83*b* closed of the other dehumidifier 80*b*, air is sucked into the closed space 71 through the dehumidifier 80*a* to compensate for a pressure drop in the closed space 71 due to condensation of the organic solvent. During this operation, the solenoid valve 85*a* is closed while the solenoid valve 85*b* is opened. Thus, hot air which is heated by the heater 86 is sent to the dehumidifier 80*b* to regenerate the drying agent in it by evaporating moisture, which is then discharged to the atmosphere through the pipe 81*b*. When the drying agent in the dehumidifier 80*a* becomes wet by the dehumidifying operation, a controller opens the solenoid valves 83*b* and 85*a* and closes the solenoid valve 83*a* and 85*b* for regeneration thereof. Thus, air is also sucked into the closed space 71 through the second dehumidifier 80*b* to compensate for the pressure drop in the closed space 71 while the first dehumidifier 80*a* undergoes regeneration. The switching between the first and second dehumidifiers 80*a* and 80*b* by means of the solenoid valves 83*a*, 83*b*, 85*a* and 85*b*** is automatically performed by counting the number of cleaning or by a timer incorporated into the controller.

With such a construction, air to be introduced into the closed space 71 through the suction pipe 30 for increasing the pressure in the closed space 71 is dehumidified on the way and always becomes dry. Thus, little water vapor in the air sucked condenses by the cooler 20 and hence little water is mixed into the solvent liquid which flows down into the trough 21. Thus, degradation of the solvent by contamination of water is prevented.

In the cleaning systems of FIGS. 2 and 15, after cleaning of the article 2 to be cleaned, the liquid solvent is discharged from the cleaning tank 1. Then, solvent vapor is supplied to the cleaning tank 1 from the vapor supplying unit 34 for vapor cleaning. In this case, there is a fear that abrupt boiling or bumping of the liquid solvent takes place in the vapor supplying unit 34 because of a considerable pressure drop in the cleaning tank 1. The pressure drop in the cleaning tank 1 is produced by discharging the liquid solvent from it with the liquid transfer pump 8 and eventually the pressure in the cleaning tank 1 drops to a vapor pressure at the temperature of the liquid solvent. If in this event, the vapor supplying unit 34 is made equal in pressure to the cleaning tank 1 by opening the solenoid valve 35 (the pressure in the vapor supplying unit 34 is lowered), the pressure in the vapor supplying unit 34 becomes lower than the vapor pressure of the solvent at the temperature thereof. This causes bumping of the liquid solvent in the vapor supplying unit 34, which bumping produces droplets of the liquid solvent. Thus, there is a possibility of such droplets of the solvent being sent to the cleaning tank 1. If these droplets come into contact with an article 2 to be cleaned in the cleaning tank 1 during the vapor cleaning, the droplets-contacted portions of the article will fail to undergo the vapor cleaning, thus deteriorating the effect of the vapor cleaning.

Figure 19:
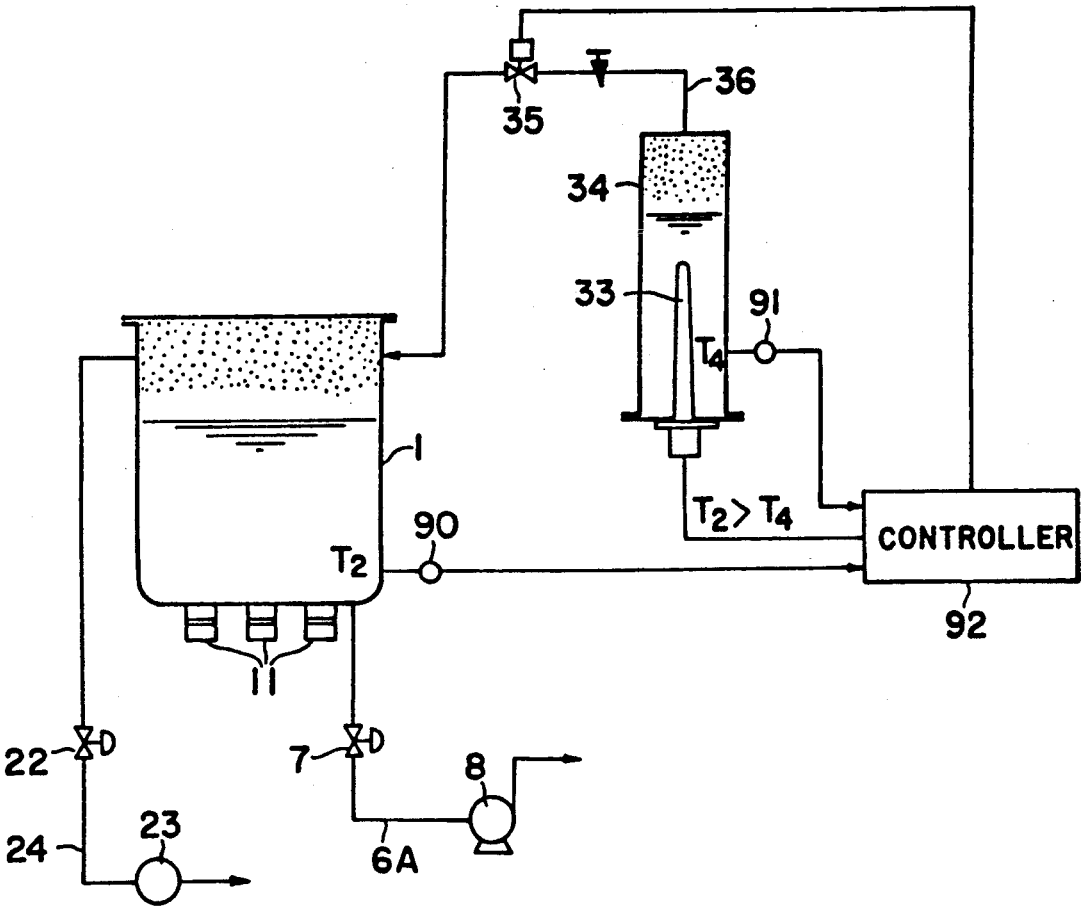
FIG. 19 is a diagrammatic view, partly in section, of a system for preventing bumping of the liquid organic solvent in the vapor generator.

This problem is solved by means of a bumping preventing system shown in FIG. 19, in which after cleaning of the article 2, the liquid solvent is discharged from the cleaning tank 1 to the storage tank by actuating the liquid transfer pump 8 in the same manner as in the preceding embodiments. In this stage of the cleaning, the temperature T2 of the liquid solvent in the cleaning tank 1 is raised slightly above the temperature T4 of the liquid solvent in the vapor generator 34. More specifically, an output signal of a temperature sensor 90, which detects the temperature T2 of the liquid solvent in the cleaning tank 1, and an output signal of a temperature sensor 91, which detects the temperature T4 of the liquid solvent in the vapor generator 34, are inputted to a controller 92 for controlling power supply to the heater 33 of the vapor generator 34. The controller 92 compares the inputted signals and according to the outcome of the comparison, controls the power supply to the heater 33 so that the temperature T2 is slightly higher than the temperature T4. In this condition, the valve 35 of the pipe 36 is opened to send the solvent vapor from the vapor generator 34 to the cleaning tank 1. When pressure in the vapor generator 34 becomes equal to the pressure in the cleaning tank 1, the former is not lower than the vapor pressure of the liquid solvent in the vapor generator 34 at the temperature T4. Thus, the bumping of the liquid solvent in the vapor generator 34 does not take place and hence there is no possibility of droplets of the solvent which are produced by the bumping being sent to the cleaning tank 1 through the pipe 36.

After the supply of the vapor solvent from the vapor generator 34 to the cleaning tank 1 is started in such a manner, the controller 92 increases the power supply to the heater 33 to raise the temperature of vapor of the solvent to be sent to the cleaning tank 1. Thus, the temperature difference between the solvent vapor which is sent to the cleaning tank 1 and the surfaces of the article to be cleaned becomes larger, so that the amount of condensation of the solvent vapor on the surfaces of the article to be cleaned increases for enhancing the effect of the vapor cleaning. While the temperature T4 of the liquid solvent in the vapor generator 34 is raised by the heater 33, the valve 35 is opened, and hence pressure in the vapor generator 34 does not become lower than the vapor pressure. Thus, there is no possibility of occurrence of the bumping of the solvent.

What is claimed is:

1. A cleaning system using solvent, comprising:

a cleaning tank including a cleaning tank body having an upper open end and a closed bottom, the cleaning tank body being adapted to receive an article to be cleaned, and a closure for sealingly closing the upper open end;

a storage tank for storing a solvent, the storage tank having an upper space filled with vapor of the solvent when the solvent is stored, said upper space being connected to a vapor supplying means for passing vapor of the solvent to the upper space, the vapor supplying means including a heater for heating and supplied vapor;

solvent supplying means connecting the storage tank to the cleaning tank for supplying the solvent from the storage tank to the cleaning tank for cleaning the article;

solvent discharging means for discharging the solvent in liquid state from the cleaning tank;

a solvent distiller, communicating with both the cleaning tank and the storage tank, for distilling the solvent from the cleaning tank and returning the distilled solvent to the storage tank;

a pressure sensor for sensing pressure in the cleaning tank to provide a pressure signal representing the pressure in the cleaning tank; and a controller for controlling, in response to the pressure signal, the relative rates of the discharge of the liquid solvent and the supply of the solvent vapor for maintaining the pressure in the cleaning tank negative.

2. A cleaning system as recited in claim 1, wherein the cleaning tank body comprises a bottom wall downwardly concave and an ultrasonic oscillator mounted to the bottom wall.

3. A cleaning system as recited in claim 1, wherein said controller controls one of both the heater and the solvent discharging means.

4. A cleaning system as recited in claim 1, wherein said control controls the flow rate of the solvent vapor to the cleaning tank.

5. A cleaning system as recited in claim 1, wherein said controller controls the rate of discharge of the liquid solvent.

6. A cleaning system using a solvent, comprising:

a cleaning tank including a cleaning tank body having an opening and a closed bottom, the cleaning tank body being adapted to receive an article to be cleaned, and a closure for sealingly closing the opening;

a storage tank for storing a liquid solvent, the storage tank having an upper space overlying the surface of the stored liquid solvent filled with vapor of the solvent;

solvent supplying means connecting the storage tank to the cleaning tank for supplying the solvent from the storage tank to the cleaning tank for cleaning the article;

a solvent distiller, communicating with both the cleaning tank and the storage tank, for distilling the solvent from the cleaning tank and returning the distilled solvent via a conduit to the storage tank, said solvent distiller having a solvent condenser; and forced solvent discharging means connecting the cleaning tank directly to said storage tank for discharging the solvent in liquid state from the cleaning tank, after cleaning the article, back directly into said upper space of the storage tank so as to raise the level of the liquid solvent in the storage tank thereby to force said vapor of the solvent within said upper space into said solvent condenser to condense the solvent vapor.

7. A cleaning system as recited in claim 6, wherein the cleaning tank comprises upper space defining means for defining an upper space in the cleaning tank, and is connected to a vapor supplying means comprising an evaporator containing liquid solvent for passing vapor of the solvent to the upper space, the vapor supplying means including a heater for heating the liquid solvent and the vapor thereof.

8. A cleaning system as recited in claim 6, wherein the cleaning tank has a suction pipe communicating with the cleaning tank for introducing air, the suction pipe including a valve for opening and closing.

9. A cleaning system as recited in claim 6, wherein further comprising air discharging means, communicating with the cleaning tanks, for discharging air from the cleaning tank.

10. A cleaning system as recited in claim 6, wherein said conduit is a connecting pipe inclining downward from the distiller to the storage tank whereby the condensed solvent in the solvent condenser flows down into the storage tank.

* * * * *

UNITED STATES PATENT AND TRADEMARK OFFICE

CERTIFICATE OF CORRECTION

PATENT NO. : 5,193,560

DATED : March 16, 1993

INVENTOR(S) : Masato Tanaka, Tadayoshi Ichikawa

It is certified that error appears in the above-identified patent and that said Letters Patent is hereby corrected as shown below:

On title page, left-hand column, item 73 ,

"Sisakusho" should be -- Seisakusho --.

Signed and Sealed this

Eighth Day of March, 1994

Bruce Lehman

*Attest:*

BRUCE LEHMAN

*Attesting Officer*

*Commissioner of Patents and Trademarks*